US006148733A

United States Patent [19]

Gagliardino

[11] Patent Number: 6,148,733

[45] Date of Patent: Nov. 21, 2000

[54] TYPE E RAILWAY COUPLER WITH EXPANDED GATHERING RANGE

[75] Inventor: Joseph L. Gagliardino, Oakdale, Pa.

[73] Assignee: McConway & Torley Corporation, Pittsburgh, Pa.

[21] Appl. No.: 09/097,437

[22] Filed: Jun. 15, 1998

[51] Int. Cl.[7] ..... B61G 7/00

[52] U.S. Cl. ..... 105/154

[58] Field of Search ..... 213/75 R, 100 R, 213/101, 104, 105, 109, 113, 114, 151, 152, 154, 100 W

[56] References Cited

U.S. PATENT DOCUMENTS

| | | | |
|---|---|---|---|
| 1,058,760 | 4/1913 | Kinne | 213/154 |
| 2,148,364 | 2/1939 | Barrows | 213/109 |
| 2,162,390 | 6/1939 | Rydin | 213/154 |
| 2,250,993 | 7/1941 | Kinne et al. | 213/154 |
| 2,797,821 | 7/1957 | Blattner | 213/154 |
| 2,832,477 | 4/1958 | Metzger | 213/154 |
| 2,920,771 | 1/1960 | Kulieke | 213/154 |
| 3,854,599 | 12/1974 | Day et al. | 213/154 |

*Primary Examiner*—Mark T. Le
*Attorney, Agent, or Firm*—James Ray & Associates

[57] ABSTRACT

A Type E railway freight car coupler having an expanded gathering range is achieved by attaching or forming an extension wing extending diagonally outward from an outer end of the gathering arm to thereby provide an extension to the angled gathering surface. The extension wing can either be cast as one piece directly with the coupler, or cast separately and welded onto the coupler.

9 Claims, 4 Drawing Sheets

TYPE E RAILWAY COUPLER WITH EXPANDED GATHERING RANGE

FIELD OF THE INVENTION

This invention relates generally to a new and improved Type E railway freight car coupler having an expanded gathering range. More particularly, this invention relates to a new and improved Type E railway freight car coupler which is modified only slightly and cheaply from conventional Type E railway freight car couplers to include an extension wing which will provide an expanded gathering range, and relates further to an extension wing for retrofitting onto a conventional Type E railway freight car coupler for converting such a prior art coupler to a coupler of this invention, and relates further to the process for making such a retro-fitted conversion.

BACKGROUND OF THE INVENTION

In 1932, the Type E coupler was adopted as the ARA, American Railway Association (predecessor to the AAR, Association of American Railroads) standard coupler for railway freight cars. Although modified periodically since then to meet changing requirements imposed by changing demands, and other coupler designs have been developed for special applications, the Type E coupler is today still the standard coupler for freight service. As the standard coupler, all producers of such couplers in the United States are required to produce the couplers to the standard specification, at least for use within the USA, so that such couplers are not only completely interchangeable, regardless of the manufacturer, but more importantly, so that the couplers from any manufacturer can readily be joined to couplers from any other domestic manufacturer.

The Type E coupler is well known to those knowledgeable in the trade as having a pivotal, vertical-knuckle adapted to engage an identical vertical-knuckle on an adjacent coupler, so that when the couplers are brought into contact with each other, the two knuckles are pivoted into an interlocking, engaging position. Each coupler includes a gravity activated coupler lock member adapted to slide downwardly after coupler engagement to virtually lock each knuckle at it's engaged position. To permit the coupler to become disengaged, each coupler lock member must be raised within its slide-channel, so that a draft load on the couplers tending to pull the cars apart, will cause the knuckles to pivot away from each other, thereby becoming disengaged.

The Type E railway coupler further includes a cast steel coupler head at the forward end extending from a shank which is fitted within and attached to a yoke, which secures the shank end of the coupler to the railway car. The forward end of the coupler head is generally V-shaped in horizontal cross-section with the "V" opening facing outwardly from an end of the railway car with the above-described vertical-knuckle pinned at one side to form one leg of the "V". The other leg of the "V" comprises a fixed and rigid gathering arm, specifically, a forwardly extending head portion extending at an angle to the coupler center line and having an angled, inside gathering surface against which the vertical-knuckle on a mating coupler is intended to impact and be pivoted inwardly to a degree sufficient: to activate the lock and thereby be locked in place. Therefore, as a pair of such railway cars, and particularly a pair of such couplers, are brought together for coupling them together, the two opposed vertical-knuckles will contact the angled gathering surface on the adjacent coupler's gathering arm and be pivoted inwardly behind each other, thereby engaging each other and locking the two couplers together, as above-described. These and other operating parts of the Type E railway coupler are well known to those familiar with the art and have been since 1932, so that a further detailed description is not believed to be necessary here.

To permit a railway train to safely negotiate curves in the tracks, the coupler shanks are pivotally secured to the railway car, so that pursuant to AAR specification, each coupler shank can pivot 13° in a horizontal plan to either side of the longitudinal center line of the railway car. Therefore, to readily join a pair of freight railroad cars together, it may be necessary to pivot the coupler shanks so that the coupler heads are generally aligned and directly opposed from each other. While proper straight alignment may naturally result when a pair of cars are disjoined while on a length of straight track, there are times, however, when they are not properly aligned for joining. For example, when a pair of cars are disjoined while oil a curved track the couplers will not normally extend perpendicularly from the end of the railway car. In addition, there are times when railway cars to be joined are on a length of curved track, and hence the coupler shanks are preferably not oriented perpendicularly from the ends of the car to be joined. Accordingly, it may be necessary for an operator or trainman to manually position the coupler or couplers by pushing or pulling it or them into proper alignment before the cars can successfully be joined together by moving one into the other. If attempts to join a pair of railway cars are made when the couplings are not properly aligned, the impact of misaligned couplers may cause damage to one or both couplers.

SUMMARY OF THE INVENTION

This invention is predicated on the development of a new and improved Type E railway freight car coupler having an enhanced gathering range which will more readily permit the coupling of a pair of adjacent railway cars regardless of the pivotal orientation of the couplers, and also more readily permit the coupling of a pair of adjacent railway cars sitting on a length of curved track.

In essence, the coupler of this invention is substantially identical to the Type E coupler of the prior art, except that the head portion of the inventive coupler is provided with a rigid extension wing extending outwardly from the end of the gathering arm to provide an extension of the angled gathering surface so that the extended gathering surface will more readily engage the pivotal knuckle of the adjacent coupler when the couplers are brought together while not properly aligned with each other. Furthermore, the coupler of this invention will in no way adversely affect a normal coupling action whereby the couplers extend perpendicularly from the ends of the railway cars pursuant to more normal practices, and can readily be joined to a conventional, prior art coupler not having such an extension wing.

OBJECTS OF THE INVENTION

Accordingly, a primary object of this invention is to provide a new and improved Type E railway freight car coupler having an enhanced gathering range.

Another primary object of this invention is to provide a Type E railway freight car coupler having an enhanced gathering range which will more readily permit the coupling of a pair of adjacent railway cars regardless of the pivotal orientation of the couplers.

A further primary object of this invention is to provide a Type E railway freight car coupler having an enhanced gathering range which will more readily permit the coupling of a pair of adjacent railway cars sitting on a length of curved track.

Still another primary object of this invention is to provide a Type E railway freight car coupler having an extension wing extending angularly outward from the coupler's gathering arm to provide an enhanced gathering range which will more readily permit the coupling of a pair of adjacent railway cars regardless of the pivotal orientation of the coupler heads.

An even further object of this invention is to provide an extension wing for attachment to a conventional Type E railway freight car coupler to provide the coupler with an enhanced gathering range which will more readily permit the coupling of a pair of adjacent railway cars regardless of the pivotal orientation of the coupler heads.

Yet an even further object of this invention is to provide a method of retr-ofitting a conventional Type E railway freight car coupler with an extension wing to enhance the coupler's gathering range, to thereby permit the coupling of a pair of adjacent railway cars regardless of the pivotal orientation of the coupler heads.

In addition to the above-described objects and advantages of the Type E coupler of this invention, various other objects and advantages of the present invention will become more readily apparent to those persons who are skilled in the same and related arts from the following more detailed description of the invention, particularly, when such description is taken in conjunction with the attached drawing figures and with the appended claims.

DESCRIPTION OF THE PREFERRED EMBODIMENT OF THE INVENTION

Figure 1:
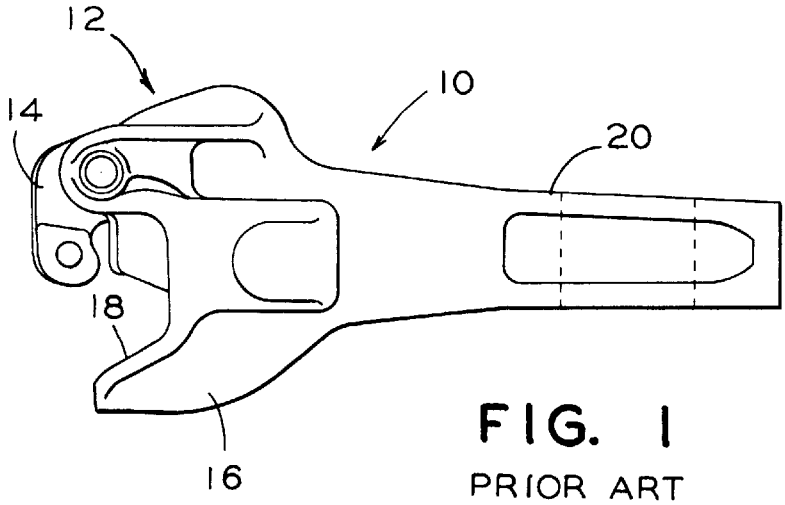
FIG. 1 PRIOR ART
FIG. 1 is a plan view of a prior art Type E railway freight car coupler.

Prior to proceeding with a detailed description of the subject invention, it is noted that for the sake of clarity, identical components which have identical functions have been identified with identical reference numerals throughout the several views of the attached drawings.

Figure 2:
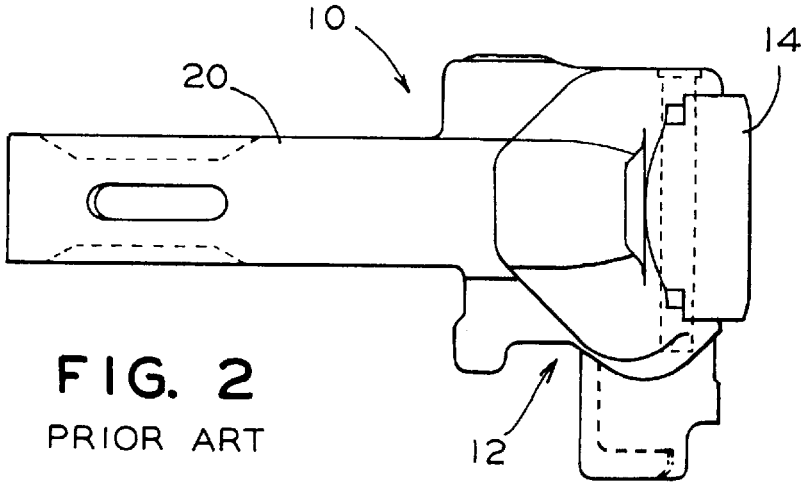
FIG. 2 PRIOR ART
FIG. 2 is a right-side elevational view of the prior art Type E railway freight car coupler shown in FIG. 1.
Figure 3:
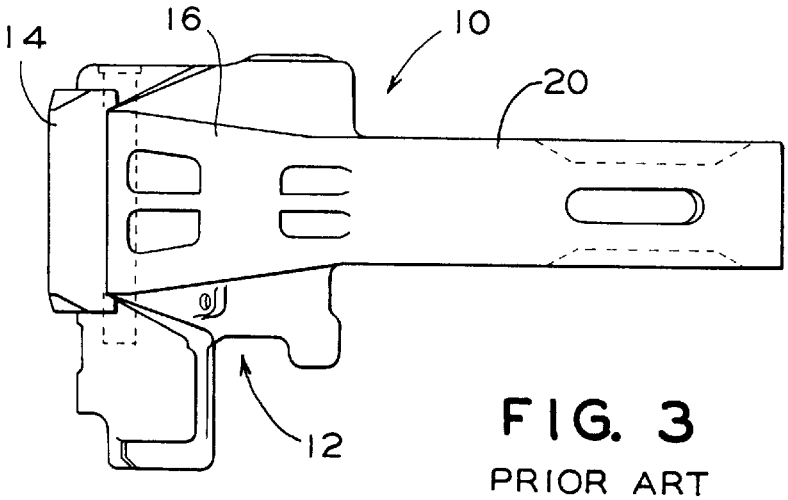
FIG. 3 PRIOR ART
FIG. 3 is a left-side elevational view of the prior art Type E railway freight car coupler shown in FIGS. 1 and 2.

Reference to FIGS. 1–3 will illustrate a conventional, prior art Type E coupler for freight railway cars as required by the AAR, and generally designated 10, which is intended for mounting within a yoke (not shown) secured at each end of a railway car center sill (not shown), such that one each coupler extends outwardly under each end of the railway car at the center line. As shown, the coupler 10 includes a generally V-shaped coupler head 12 at a forward end thereof extending from a shank 20 adapted to be fitted within and attached to a yoke (not shown) secured at each end of the center sill (not shown) which extends full length under the railway car (not shown) at the longitudinal axis. The generally V-shaped coupler head 12 has a vertical-knuckle 14 rotatably pinned at an outer end of coupler head 12 forming a first leg of the generally V-shaped coupler head 12, while a second leg of the generally V-shaped coupler head 12 comprises a fixed and rigid gathering arm 16 having a first angled gathering surface 18 against which a vertical-knuckle 14 on a mating coupler (not shown but like coupler 10) is intended to impact when two adjacent railway cars are brought together. When vertical knuckle 14, (and its identical counter-part on the adjacent coupler) impacts against the angled gathering face 18, on the other coupler gathering arm 16, it as well as the opposing vertical knuckle 14, are each pivoted inwardly to a degree sufficient to lock them in place behind each other so that the couplers 10 are properly joined together. A lock member (not shown) slidably disposed within each coupler head 12, is activated by the engagement to slide downwardly within the coupler head 12 and lock the vertical knuckle 14 in place to thereby join the two railway cars (not shown) together. Such an operation is so well known to those familiar with the art, that further description is not believed to be necessary here, suffice it to say that to assure a successful coupling together, the two railway cars (not shown) should preferably be sitting on a straight length of track, and the two couplers, like coupler 10, should preferably be at least generally oriented parallel to the track and perpendicular to the end of the railway car to face each other to assure a proper coupling.

Figure 4:
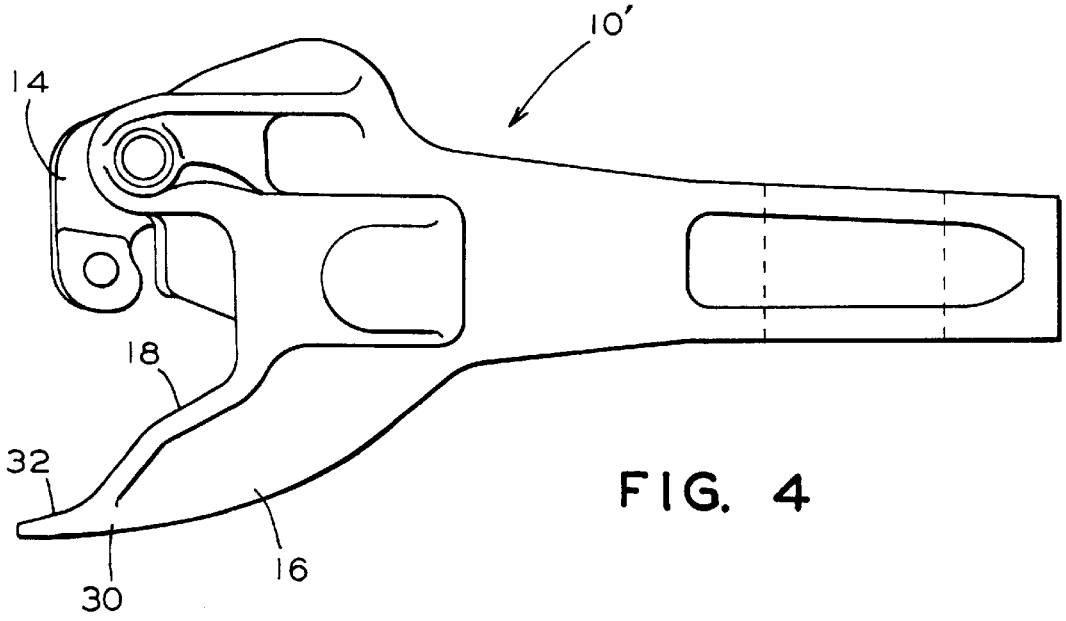
FIG. 4 is a plan view of a Type E railway freight car coupler having an expanded gathering range according to a presently preferred embodiment of this invention.
Figure 5:
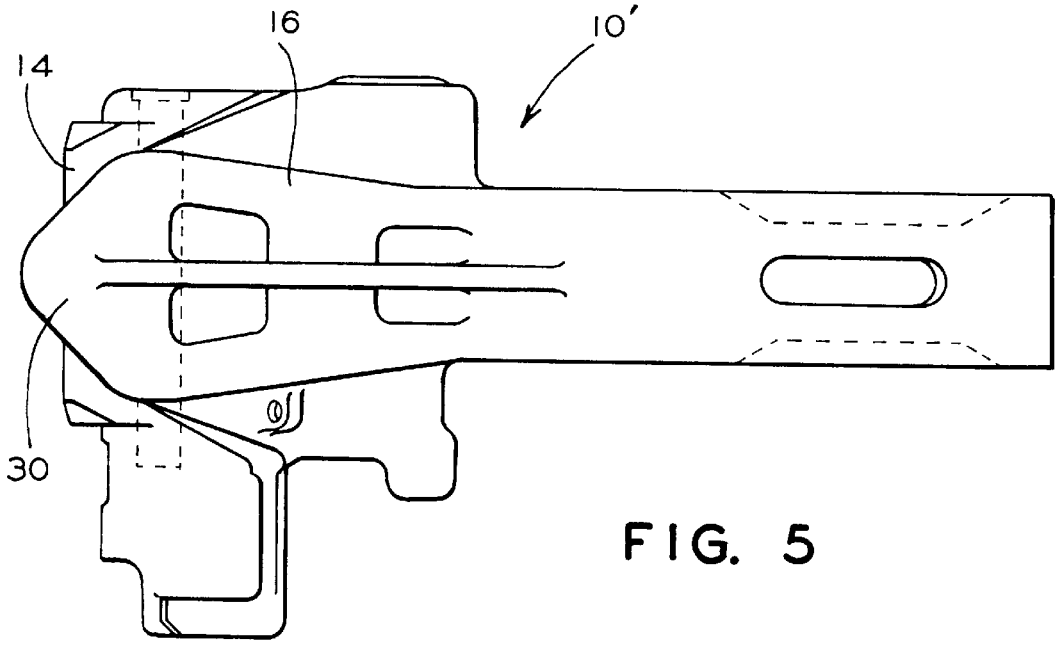
FIG. 5 is a right-side elevational view of the inventive Type E railway freight car coupler shown in FIG. 4.

The crux of this invention is to provide a coupler in which the two last above-noted requirements are not essential, and particularly to provide a coupler which can readily be joined to a like coupler when the railway cars to which they are mounted are sitting on a length of curved track, or are otherwise not properly aligned with each other. Reference to FIGS. 4 and 5 will illustrate a presently preferred embodiment of the new and unique coupler 10' of this invention, which for all intents and purposes, is substantially identical to a conventional Type E coupler 10 described above with reference to FIGS. 1–3, except for the fact that coupler 10' includes an extension wing 30, extending angularly outwardly at least about 6 inches from the outer end of gathering arm 16. Extension wing 30 further includes a gathering surface extension 32, which extends angularly outward from gathering surface 18 to virtually create an elongated gathering surface 18-32. Accordingly, the inventive coupler having an expanded gathering range is essentially the same as a prior art coupler except that it has an elongated gathering arm together with an extension to the gathering surface, extending outwardly at least about 6 inches in a direction generally parallel to the gathering surface. Specifically, the elongated gathering arm comprises gathering arm 16 plus extension wing 30 to form gathering arm 16-30, while the elongated gathering surface comprises gathering surface 18 plus gathering surface extension 32 to form elongated gathering surface 18-32. As should be apparent, the extended gathering surface 18-32 will contact and engage an opposed vertical knuckle 14 even when the two opposed couplers 10' are not directly opposed from each other, and even when each coupler shank 20 is pivoted in opposite directions.

Figure 6:
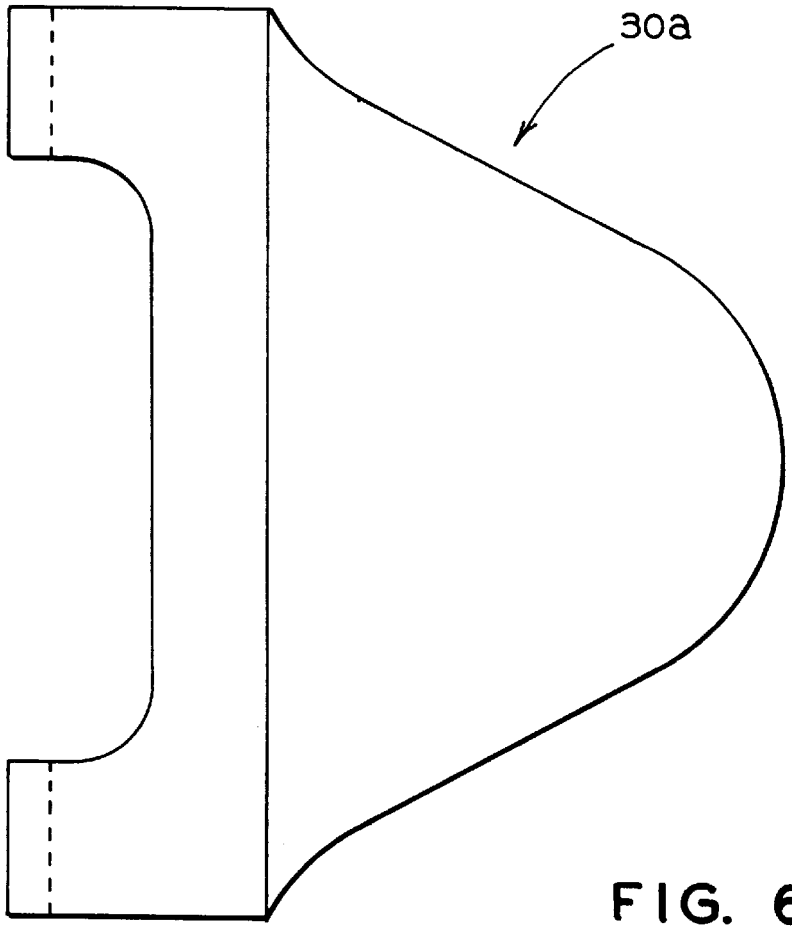
FIG. 6 is a plan view of an extension wing for retro-fitting onto a prior art Type E railway freight car coupler for converting such prior art coupler to a coupler of this invention.
Figure 7:
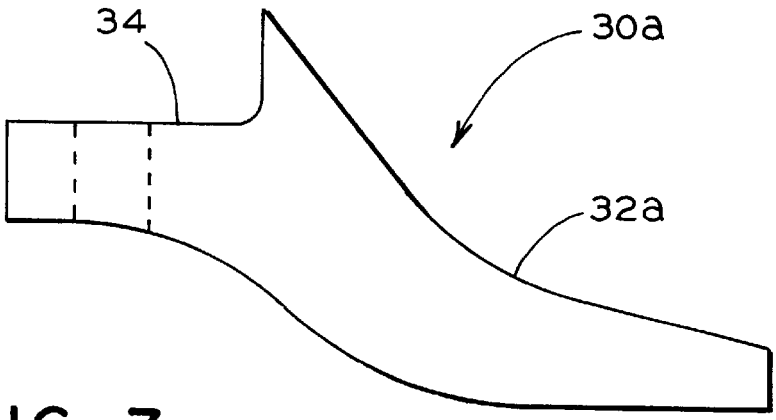
FIG. 7 is a right-side edge view of the extension wing shown in FIG. 6.

While the inventive coupler head can be originally manufactured as a single casting to include the extension wing 30 as shown in FIGS. 4 and 5, an additional embodiment of this invention includes an independently cast extension wing 30*a* as shown in FIGS. 5 and 6 for attachment by welding or otherwise onto a conventional, prior art gathering arm 16, thereby retro-fitting such a conventional prior art coupler to be in accordance with the inventive coupler having an enhanced gathering range, pursuant to this invention. Reference to FIGS. 6 and 7 will illustrate a presently preferred embodiment of such an extension wing, generally designated 30*a*. Extension wing 30*a* is a three-dimensional body of cast steel or the like, which includes a first surface 32*a*, which is intended to form the extension of gathering surface 18. A second surface 34 has a predetermined configuration which is adapted to be joined onto the end of gathering arm 16. While the other surfaces of extension wing 30*a* are not particularly critical, they should preferably be designed to provide an extension of the peripheral surfaces of gathering arm 16 from which they extend, and provide sufficient mass to the extension wing 30*a* to effect an adequate impact strength to assure that it is not fractured during coupling.

Figure 8:
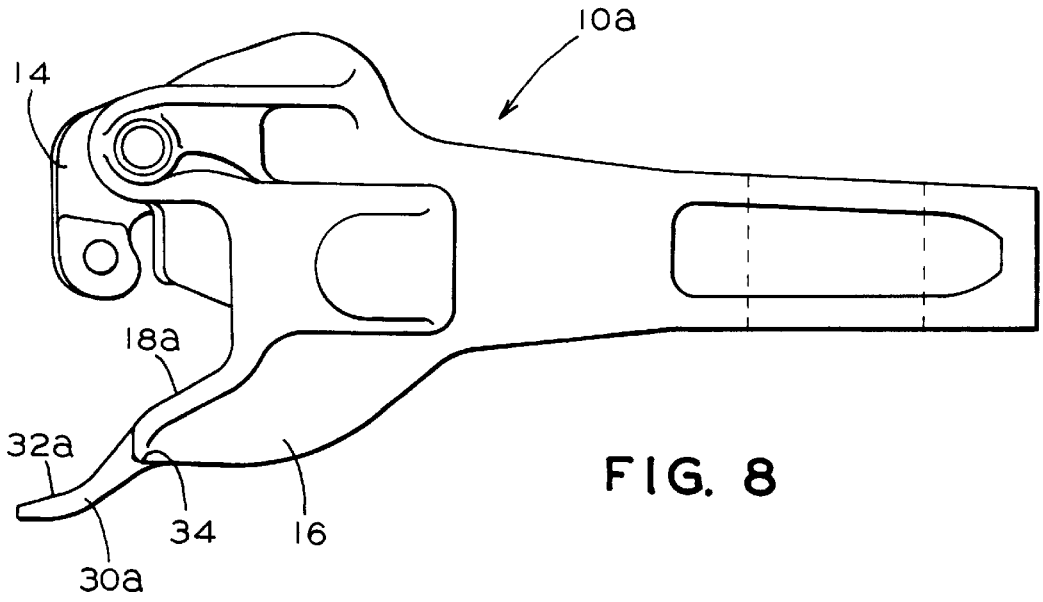
FIG. 8 is a plan view of a prior art Type E railway freight car coupler having an extension wing as shown in FIGS. 6 and 7 retro-fitted onto the gathering arm to expand its gathering range according to another presently preferred embodiment of this invention.
Figure 9:
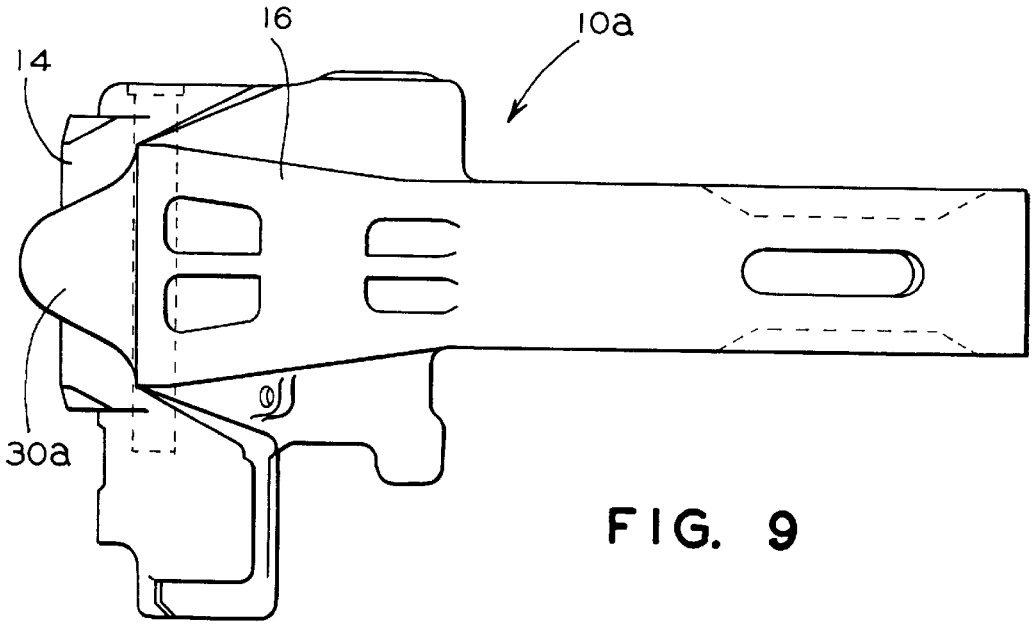
FIG. 9 is a right-side elevational view of the retro-fitted Type E railway freight car coupler shown in FIG. 8.

While any one of a number of different techniques can be utilized for welding extension wing 30*a* onto gathering arm 16, a currently preferred method, as shown in FIGS. 8 and 9, is to provide second surface 34 on extension wing 30*a* with a concave or right-angled configuration adapted to mate with the existing outer end of gathering arm 16. Preferably, the periphery of second surface 34 is provided with a angled taper for the purposes of facilitating welding. After welding, the weld surfaces, and particularly the weld surface at gathering surface 18*a*-32*a* should be ground to provide a smooth surface transition between the joined components so that a vertical knuckle 14 on an adjacent coupler will slidably move from along the elongated gathering surface 18*a*-32*a* without any hang-up or interference by the interface.

An alternate method would be to provide a second surface as a flat surface on extension wing 30*a* generally transverse to surface 32*a*. In such a method, the tip portion of gathering arm 16 is cut-off, as with a cutting torch, saw or the like, to effect a resulting cut surface on gathering arm 16 that will be of a size and configuration adapted to mate with flat second surface 34. Accordingly, flat surface 34 can then be welded onto the flat cut surface on gathering arm 16. AS in the first described method, a tapered periphery around surface 34 may be desired to facilitate welding. As described before, the weld surfaces, and particularly the weld surface at gathering surface 18*a*-32*a* should be ground to provide a smooth surface transition between the joined components so that a vertical knuckle 14 on an adjacent coupler will slidably move along the elongated gathering surface without any hang-ups or interference by the interface.

While three presently preferred embodiments of the invention have been described and illustrated in detail above, it should be apparent to those persons skilled in the art that various other embodiments, adaptations and modifications of the invention could be made without departing from the spirit and scope of the invention, particularly with regard to the method of welding, or otherwise joining the extension wing onto the gathering arm. For example, the first surface of the extension wing 30*a* can, if desired, be shaped to a concave form adapted to generally match the convex tip of the gathering arm 16 with the two components joined by a thermite welding procedure. If preferred to enhance the weld union, interface surfaces other than flat or concave-convex can be formed such as tongue-in-groove like interfaces. Indeed, other welding techniques could be utilized with equal or perhaps even better results. Accordingly, a number of different embodiments could be developed in both the extension wing and method of joining it to a prior art coupler could be made without departing from the spirit of the invention.

I claim:

1. A Type E railway freight car coupler having an expanded gathering range for attachment to a railway freight car, said Type E railway freight car coupler being a substantially non-interlocking freight car coupler and comprising: a generally V-shaped coupler head at a forward end thereof having a vertical-knuckle rotatably pinned at an outer end of said coupler head to form a first leg of said generally V-shaped coupler head, and a gathering arm extending diagonally outwardly from said coupler head to form a second leg of said generally V-shaped coupler head, said gathering arm having a first angled gathering surface against which a vertical-knuckle on a mating coupler is intended to impact and be pivoted inwardly to a degree sufficient to be locked in place, and an extension wing extending diagonally outward from an outer end of said gathering arm by a distance of at least about 6 inches, said extension wing being substantially fixed and rigid with respect to said gathering arm, and said extension wing having a second angled gathering surface adapted to provide an extension of said first angled gathering surface, said vertical-knuckle having a vertical dimension extending substantially vertically along said coupler head, and said extension wing protruding outward from said coupler head within at least a portion of said vertical dimension of said vertical-knuckle.

2. A Type E railway freight car coupler having an expanded gathering range, in accordance with claim 1, in which said gathering arm and said extension wing are formed together as a single component with said first angled gathering face and said second angled gathering face contiguous as a single elongated gathering face.

3. A Type E railway freight car coupler having an expanded gathering range, in accordance with claim 1, wherein said extension wing protrudes outward from and beyond approximately a midpoint of said vertical dimension of said vertical-knuckle when said vertical-knuckle is in an inwardly rotated position.

4. A Type E railway freight car coupler having an expanded gathering range, in accordance with claim 2, in which said single component forming said single elongated gathering face is formed of cast steel.

5. A Type E railway freight car coupler having an expanded gathering range, in accordance with claim 1, in which said extension wing extends diagonally outward from said gathering arm by a distance of from 6 inches to 9 inches.

6. In a Type E railway freight car coupler having a generally V-shaped coupler head at a forward end thereof extending from a shank adapted to be fitted within and attached to a yoke, said generally V-shaped coupler head having a vertical-knuckle rotatably pinned at an outer end of said coupler to form a first leg of said generally V-shaped coupler head, and a gathering arm extending diagonally outwardly from said coupler head to form a second leg of said generally V-shaped coupler head, said gathering arm having a first angled gathering surface against which a vertical-knuckle on a mating coupler is intended to impact and be pivoted inwardly to a degree sufficient to be locked in place, the improvement comprising:

means for expanding the gathering range of said Type E railway freight car coupler, said Type E railway freight car coupler being a substantially non-interlocking freight car coupler, said means for expanding including, an extension wing extending diagonally outward from an outer end of said gathering arm, said extension wing being substantially fixed and rigid with respect to said gathering arm, said extension wing extending diagonally outward from said gathering arm by distance of at least about 6 inches, said extension wing having a second angled inner surface adapted to provide an extension to said first angled gathering surface, said first and second gathering surfaces thereby providing an elongated gathering surface, said vertical-knuckle having a vertical dimension extending substantially vertically along said coupler head, and said extension wing protruding outward from said coupler head within at least a portion of said vertical dimension of said vertical-knuckle.

7. A Type E railway freight car coupler having an expanded gathering range, in accordance with claim 6, in which said gathering arm and said extension wing are formed together as a single component with said first angled gathering face and said second angled gathering face contiguous as a single elongated gathering face.

8. A Type E railway freight car coupler having an expanded gathering range, in accordance with claim 6, wherein said extension wing protrudes outward from and beyond approximately a midpoint of said vertical dimension of said vertical-knuckle when said vertical-knuckle is in an inwardly rotated position.

9. A Type E railway freight car coupler having an expanded gathering range, in accordance with claim 7, in which said single component forming said single elongated gathering face is formed of cast steel.

* * * * *